United States Patent [19]

Neumaier et al.

[11] Patent Number: 4,825,961

[45] Date of Patent: May 2, 1989

[54] DRILLING DEVICE

[75] Inventors: Anton Neumaier, Fürstenfeldbruck; Hans-Jürgen Hoereth, Langenback, both of Fed. Rep. of Germany

[73] Assignee: Hilti Aktiengesellschaft, Fürstentum, Liechtenstein

[21] Appl. No.: 147,615

[22] Filed: Jan. 22, 1988

Related U.S. Application Data

[63] Continuation of Ser. No. 891,461, Jul. 29, 1986, abandoned.

[30] Foreign Application Priority Data

Jul. 29, 1985 [DE] Fed. Rep. of Germany ..... 3527091

[51] Int. Cl.[4] ..... B25D 9/04

[52] U.S. Cl. ..... 173/109; 173/47

[58] Field of Search ..... 173/47, 104, 109, 123, 173/163; 74/361, 404, 376; 408/124, 137; 81/464; 192/21

[56] References Cited

U.S. PATENT DOCUMENTS

| | | | |
|---|---|---|---|
| 991,094 | 5/1911 | Schneider | 173/163 |
| 1,170,041 | 2/1916 | Brennan | 74/404 |
| 1,170,171 | 2/1916 | Lane | 74/404 |
| 1,475,982 | 12/1923 | Buhr | 74/404 |
| 1,936,108 | 11/1933 | Edwards | 74/404 |
| 2,473,816 | 6/1949 | Perkins | 74/376 |
| 2,591,516 | 4/1952 | Darnell | 192/21 |
| 2,793,305 | 5/1957 | Gerentes | 173/163 |
| 3,114,423 | 12/1963 | Nuslund . | |
| 3,828,863 | 8/1974 | Bleicher et al. | 173/109 |
| 4,217,964 | 8/1980 | Eaton | 192/21 |
| 4,619,162 | 10/1986 | Van Laere | 173/104 |

FOREIGN PATENT DOCUMENTS

| | | |
|---|---|---|
| 2043805 | 9/1970 | Fed. Rep. of Germany . |
| 2920065 | 11/1980 | Fed. Rep. of Germany . |
| 647174 | 1/1985 | Switzerland . |

*Primary Examiner*—Frank T. Yost
*Assistant Examiner*—James L. Wolfe
*Attorney, Agent, or Firm*—Toren, McGeady & Associates

[57] ABSTRACT

In a drilling device, a tool mounted in the device can be selectively switched from right-hand rotation to left-hand rotation. The tool can be connected to an output shaft on which two conical gear wheels are mounted in spaced relation so that they can be rotated in opposite directions around the output shaft. The teeth on the conical gear wheels face one another and are in meshed engagement with gear teeth on a drive shaft. A coupling part is slidably displaceably mounted on the output shaft and can be engaged with one or the other of the conical gear wheels. The coupling part is secured on the output shaft so that as it is rotated by one or the other conical gear wheels, in turn, it rotates the output shaft in the desired direction.

3 Claims, 1 Drawing Sheet

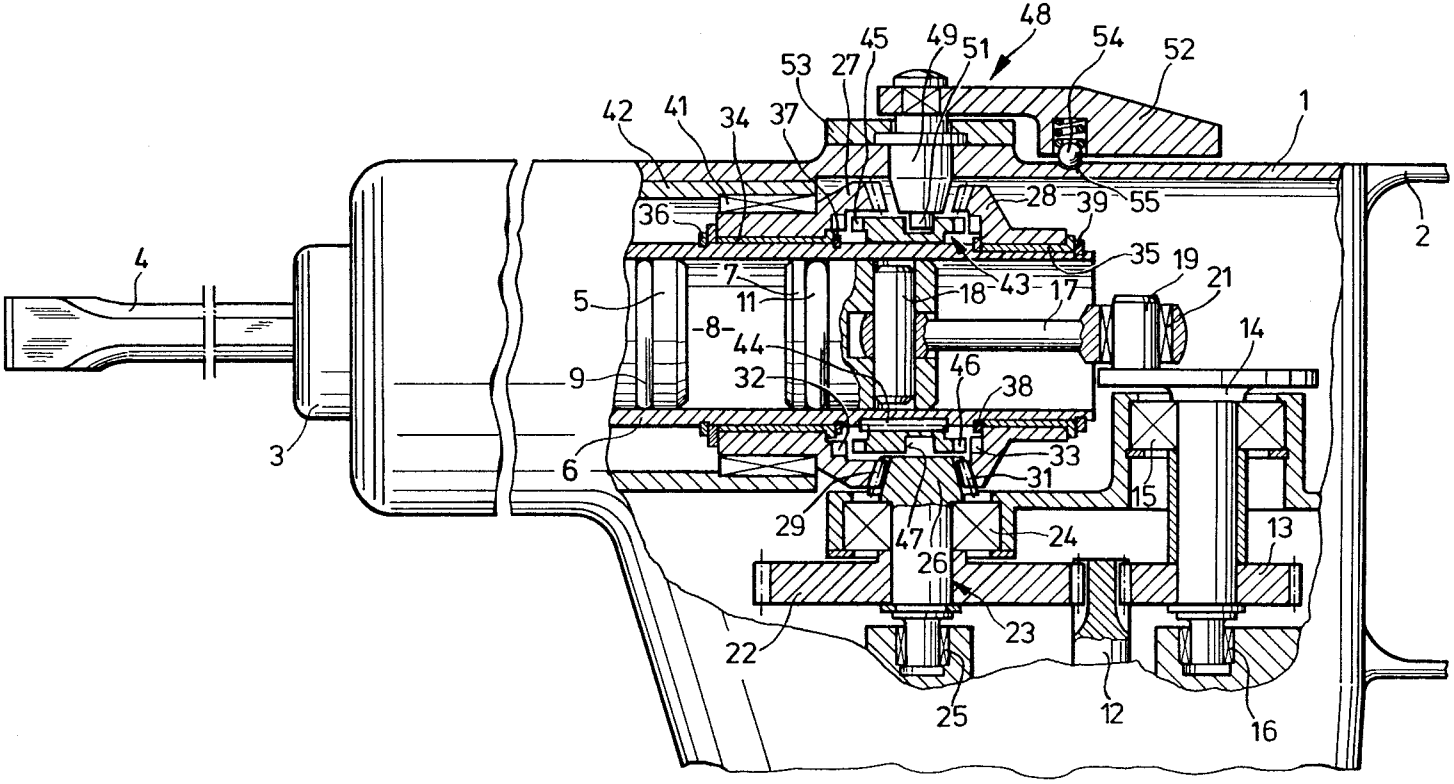
1
2
3
4
5
6
7
8
9
11
12
13
14
15
16
17
18
19
21
22
23
24
25
26
27
28
29
31
32
33
34
35
36
37
38
39
41
42
43
44
45
46
47
48
49
51
52
53
54
55

DRILLING DEVICE

This is a continuation of application Ser. No. 891,461, filed July 29, 1986 now abandoned.

BACKGROUND OF THE INVENTION

The present invention is directed to a drilling device which can be selectively switched between right-hand or left-hand rotation and includes an output shaft for rotating a tool mounted in the drilling device. Gear wheels are rotatably supported on the output shaft so that they rotate in opposite directions. A coupling part is arranged for selective engagement with said gear wheels for rotating the output shaft. The coupling part is displaceable along the output shaft.

A known drilling device in the form of a hand tool includes a switching gear unit for effecting right-hand or left-hand rotation of an output shaft during uniform rotation of a motor in one direction. The switching gear unit comprises toothed wheels in the form of spur gear wheels rotatably supported on the output shaft. A drive shaft transmits rotational movement to the toothed wheels with one toothed wheel in meshed engagement with a gear rim on the drive shaft while the other toothed wheel is driven via an intermediate toothed wheel.

SUMMARY OF THE INVENTION

Therefore, the primary object of the present invention is to provide a drilling device of simple construction for effecting either right-hand or left-hand rotation or for discontinuing the rotational movement.

In accordance with the present invention, two toothed or gear wheels are spaced axially apart from one another on an output shaft and are in the form of conical gear wheels with the conical gear teeth facing one another in the axial direction so that the conical gear teeth mesh with teeth on the drive shaft.

Opposite rotational motion is transmitted to the output shaft with the conical gear teeth on the gear wheels facing one another and in engagement with the teeth on the drive shaft without requiring the use of an intermediate gear wheel. The conical gear wheels are driven by the drive shaft with the teeth of the conical gears in meshed engagement with the teeth on the drive shaft so that each conical gear wheel is rotated at the same speed. If unequal rotational speeds for the conical gear wheels are advantageous, separate teeth with different dimensions can be provided on the drive shaft for engagement with the conical gear wheels. The teeth on the conical gear wheels can be straight or curved.

If the drilling device is a so-called hammer drill, it must be possible to discontinue the rotational motion for cutting or chiselling operations. The switching action is achieved in a simple manner by a displaceable coupling part which can be positioned out of meshed engagement with either of the two conical gear wheels in a middle position. Right-hand or left-hand rotation of the output shaft, and of the tool, can be achieved by displacing the coupling part from the middle position to one or the other of its end positions.

Preferably, the teeth on the drive shaft are arranged between the teeth on the conical gear wheels. The axis of the drive shaft extends perpendicularly to the axis of the conical gear wheels. In this way, a simple transmission of the rotational motion from the drive shaft to the conical gear wheel is ensured.

In a preferred embodiment, the part of the drive shaft in meshed engagement with the conical gear wheels is formed with teeth as a conical pinion. The conical pinion has teeth which correspond with the teeth on the conical gear wheels. Driving the two conical gear wheels by a single conical pinion affords a simple arrangement of the device and provides disturbance-free operation of the switching gear unit.

Another important feature of the present invention is the provision of means on the conical gear wheels for engagement with the coupling part. The engagement means on the conical gear wheels face one another. A plurality of spaced teeth extending around a circumferential path are suitable as the engagement means. Claws or jaws, corresponding to the engagement spaces on the conical gear wheels, are formed on the coupling part and can be displaced into form-locking engagement with the engagement spaces. The coupling part is displaceable along the axial direction of the output shaft and is secured to the output shaft by an adjusting spring or the like so that the coupling part and the output shaft can rotate as a unit. The displacement of the preferably annular coupling part can be effected on the outside of the drilling device, for example, by means of an eccentric handle.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

BRIEF DESCRIPTION OF THE DRAWING

In the drawing a partial side elevational view of a drilling device is shown, partly in section, with a switching gear located so that the drilling device does not rotate.

DETAILED DESCRIPTION OF THE INVENTION

In the side elevational view of the drawing a portion of a hammer drill is illustrated including a housing 1 with the front end of the housing directed to the left and the back end of the housing shown partly on the right with a portion of a handle 2 attached to the back end of the housing. A tool holder 3 projects outwardly from the front end of the housing 1. A tool in the form of a flat chisel 4 is inserted into the tool holder 3 and the hammer drill, as illustrated, is arranged to provide percussive movement to the chisel 4 without rotating the chisel.

Percussive force is transmitted to the flat chisel 4 by a percussion piston 5. Percussion piston 5 is axially displaceably supported within a cylindrically shaped hollow output shaft 6. The percussion piston is located in the forward end of the output shaft 6 and an axially displaceable drive piston 7 is located within the bore through the output shaft 6 spaced axially from the percussion piston 5. By the reciprocating stroke movement of the drive piston 7, an air cushion 8, located between the pistons 5, 7, is alternately compressed and released, so that the percussion piston is similarly reciprocated within the bore of the output shaft 6 for transmitting the percussive force to the tool or chisel 4 located in the tool holder 3. Percussion piston 5 and drive piston 7 each have sealing rings 9, 11 for maintaining the air cushion 8 between them.

The reciprocating action of the drive piston 7 is effected by a drive motor. A driven pinion 12 of the drive motor, not shown, drives a crankshaft 14 by means of a gear wheel 13. Crankshaft 14 is rotationally supported by roller bearings 15,16 mounted within the housing 1. A connecting rod 17 is connected to the crankshaft 14 by a crankpin 19 and to the drive piston 7 by a crosspin 18. A roller bearing 21 supports the connecting rod 17 on the crankpin 19. The driven pinion 12 is also in meshed engagement with a gear wheel 22 secured on a drive shaft 23 so that the gear wheel and drive shaft rotate as a unit. Drive shaft 23 is rotatably supported in the housing 1 by roller bearings 24, 25. A conical pinion 26 is located at the upper end of the drive shaft 23 and is in meshed driving engagement with two conically shaped gear wheels 27, 28 each mounted on and extending around the output shaft 6. The gear teeth 29, 31 on the conical gear wheels 27, 28 are spaced apart in the axial direction of the output shaft 6 and each is rotated in an opposite direction by the conical pinion 26. On the facing sides of the conical gear wheels 27, 28 engagement means 32, 33 are provided spaced radially inwardly from the conical gear teeth 29, 31. The engagement means 32, 33 are in the form of spaced teeth or recesses. The conical gear wheels 27, 28 are mounted on the output shaft 6 by slide bearings 34, 35 so that the conical gear wheels can rotate relative to the output shaft, however, they are fixed in the axial direction of the shaft by locking rings 36, 37, 38, 39. In addition, a roller bearing 41 is supported about its radially outer surface by a guide tube 42 mounted within the housing 1. The roller bearing 41 is in surface contact with the conical gear wheel 27 on its radially inner surface. Guide tube 42 is secured within the housing against rotation relative to the housing. Accordingly, the output shaft 6 is rotatably supported relative to the housing 1. An annular coupling part 43 encircles the outer surface of the output shaft 6 and is positioned between the conical gear wheels 27, 28. The conical gear wheel 27, 28 have the engagement means 32, 33 which face toward the coupling part 43. Coupling part 43 is supported by a feather or key 44 so that it is axially displaceable on the outside of the output shaft, but is arranged to rotate with the output shaft, that is, the coupling part transmits rotational movement to the output shaft. The ends of the coupling part spaced apart in the axial direction of the output shaft are provided with claws or jaws 45, 46 located opposite the engagement means 32, 33 and the claws can be selectively engaged with the engagement means for transmitting rotation from one or the other of the conical gear wheels 27, 28 to the output shaft 6. By axially sliding the coupling part on the outside of the output shaft 6, the claws 45 can be selectively engaged with the engagement means 32 or the claws 46 can be selectively engaged with the engagement means 33. In addition, the coupling part can be held in a neutral position, as shown in the drawing, where the claws 45, 46 are spaced from the engagement means 32, 33. Accordingly, depending on the end positions of the coupling part where it is engaged with one or the other of the conical gear wheels 27, 28, the output shaft 6 can be rotated in the right-hand or left-hand direction.

For its displacement in the axial direction of the output shaft 6, the coupling part has an annular groove 47 formed in and encircling its outer surface with an eccentric handle 48 in engagement with the groove. Eccentric handle 48 includes a pin 49 rotatably supported in the housing 1 with an eccentrically arranged cam 51 extending into the annular groove 47. An actuating handle 52 is connected to the pin 49 so that the handle and pin rotate as a unit. A disc 53 is fastened to the housing and supports the pin on the exterior of the housing. The actuating handle has a locking or catch ball 54 which can be held within one of three catch recesses 55 formed in the housing 1 for locking the coupling part in the desired position. By pivoting the actuating handle 52 and the pin 49 the coupling part can be selectively engaged with one or the other of the conical gear wheels 27, 28 for providing the rotation of the output shaft 6. As viewed in FIG. 1, the handle is in an intermediate neutral position so that no rotation is transmitted to the output shaft 6, however, if the coupling part 43 is moved to the right from the position shown in the drawing the output shaft 6 will be rotated by the conical gear wheel 28. On the other hand, if the coupling part is displaced axially to the left from the position shown in the drawing, the coupling part will engage the conical gear wheel 27 for effecting the rotation of the output shaft 6. Accordingly, by selectively positioning the handle 52 the coupling part 43 can be slidably displaced in the axial direction of the output shaft whereby the output shaft can be rotated in the left-hand or right-hand direction or rotational movement can be cut off.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

We claim:

1. Drilling device capable of being switched between right-hand rotation and left-hand rotation comprising means for effecting rotation including a rotatable axially extending output shaft for providing the rotation of a tool inserted into said drilling device, a first gear wheel and a second gear wheel mounted on said output shaft for rotation relative thereto, a drive shaft engageable with said first and second gear wheels for driving said first and second gear wheels in opposite directions around said output shaft, a coupling part selectively engageable with said first and second gear wheels so that when said coupling part engages one of said first and second gear wheels said coupling part is in disengaged relation with the other one of said first and second gear wheels, said coupling part being axially displaceable along said output shaft, wherein the improvement comprises means for connecting said coupling part to said output shaft whereby rotation of said coupling part by one of said first and second gear wheels rotates said output shaft, said first and second gear wheels encircle said output shaft and are spaced apart from one another in the axial direction of said output shaft and are fixed to said output shaft in the axial direction thereof, said coupling part encircling said output shaft and located thereon between said first and second gear wheels, each of said first and second gear wheels is a conical gear wheel having conical gear teeth thereon entending in the axial direction of said output shaft and facing one another, said drive shaft having a conical pinion with conical gear teeth thereon and said conical gear teeth being in meshed engagement with said first and second conical gear wheels so that said conical pinion drives both of the conical gear wheels of said first and second gear wheels in opposite directions at the same time, said first and second conical gear wheels include engagement means spaced from said conical gear teeth thereon, and said coupling part has an annular arrangement of claws formed on each of its ends spaced apart in the axial direction of said output shaft and extending around said output shaft and being selectively engageable with said engagement means when said coupling part is axially displaced on said output shaft.

2. Drilling device, as set forth in claim 3, including a housing enclosing said output shaft, said coupling part and said conical gear wheels, means mounted on the outside of said housing and extending inwardly through the housing into engagement with said coupling part for effecting the axial displacement of said coupling part.

3. Drilling device, as set forth in claim 2, wherein said means for connecting said coupling part to said output shaft comprises a key connecting said coupling part to said output shaft so that said coupling part is axially displaceable on said shaft and said coupling part and output shaft rotate as a unit when said coupling part is in engagement with one of said conical gear wheels.

* * * * *